US008520049B2

(12) United States Patent
Takahashi et al.

(10) Patent No.: US 8,520,049 B2
(45) Date of Patent: Aug. 27, 2013

(54) FIXING MECHANISM OF OPTICAL SCANNING DEVICE AND IMAGE FORMING APPARATUS

(75) Inventors: Hiroki Takahashi, Osaka (JP); Masato Ohnishi, Osaka (JP); Kousuke Uchida, Osaka (JP)

(73) Assignee: Kyocera Document Solutions Inc. (JP)

( * ) Notice: Subject to any disclaimer, the term of this patent is extended or adjusted under 35 U.S.C. 154(b) by 135 days.

(21) Appl. No.: 13/074,347

(22) Filed: Mar. 29, 2011

(65) Prior Publication Data

US 2011/0242265 A1 Oct. 6, 2011

(30) Foreign Application Priority Data

Mar. 30, 2010 (JP) ..... P2010-078006

(51) Int. Cl.
*B41J 2/435* (2006.01)

(52) U.S. Cl.
USPC ..... 347/263; 347/245

(58) Field of Classification Search
None
See application file for complete search history.

(56) References Cited

U.S. PATENT DOCUMENTS

2007/0279719 A1* 12/2007 Miyamoto et al. ..... 359/198

FOREIGN PATENT DOCUMENTS

| | | |
|---|---|---|
| JP | 2-220072 | 9/1990 |
| JP | A-2000-284157 | 10/2000 |
| JP | A-2001-071552 | 3/2001 |
| JP | A-2004-050671 | 2/2004 |

* cited by examiner

*Primary Examiner* — Matthew Luu
*Assistant Examiner* — Kendrick Liu
(74) *Attorney, Agent, or Firm* — Ostrolenk Faber LLP

(57) ABSTRACT

A fixing mechanism of an optical scanning device, the optical scanning device emitting a light beam and performing a scanning, the optical scanning device further being fixed to a frame at an external part, the optical scanning device further including a housing, and the fixing mechanism including: a penetration hole provided in the frame; and a protruding pin provided at both ends of the housing thereby forming a plurality of protruding pins, wherein at least one of the plurality of protruding pins is insertable to the penetration hole formed in the frame; and a biasing member biasing the housing in a direction.

2 Claims, 6 Drawing Sheets

FIXING MECHANISM OF OPTICAL SCANNING DEVICE AND IMAGE FORMING APPARATUS

The present application claims priority on Japanese Patent Application No. 2010-078006, filed Mar. 30, 2010, the content of which is incorporated herein by reference.

BACKGROUND OF THE INVENTION

1. Field of the Invention

The present invention relates to a fixing mechanism of an optical scanning device and an imaging forming apparatus.

2. Description of the Related Art

Conventionally, an optical scanning device, which has been one of the primary components of an image forming unit equipped in an image forming device such as a copier and a complex machine, comprises a housing such that a light beam is guided in an interior. This housing is supported by being fixed to a frame provided within a chassis of an image forming apparatus.

According to an example of a fixing mechanism of an optical scanning device which has been suggested, a housing of the optical scanning device is screw-fastened using a standard pin such that a screw part is provided on a frame.

However, a heat generating part such as a polygon motor, which scans a light beam, is stored inside the housing. Therefore, it is not possible to prevent the housing from deforming due to the heat generated by the heat generating part. When a deformation due to heat cannot be released due to the housing being completely screw-fastened to the frame, a significant, localized heat deformation occurs. When such a heat deformation occurs on the housing, the location of the scanning line may deviate, thereby causing a deterioration in the quality of printing.

Further, according to the conventional housing, the housing of the optical scanning device is screw-fastened to the frame, as described above. As a result, the assembling operation cannot be performed efficiently. Further, there is a problem in that a staff member with specialized technical knowledge is required in order to exchange the optical scanning device.

Considering the problems described above, the present invention aims to prevent a deviation in the position of a light beam caused by a heat deformation of a housing. At the same time, the present invention aims to make the assembling process easier such that a user may exchange the optical scanning device on his or her own.

SUMMARY OF THE INVENTION

In order to achieve the above object, the present invention employs the following.

Namely a fixing mechanism of an optical scanning device according to an aspect of the present invention is such that the optical scanning device emits a light beam and performs a scanning, the optical scanning device is fixed to a frame at an external part, the optical scanning device further includes a housing, and the fixing mechanism includes: a penetration hole provided in the frame; and a protruding pin provided at both ends of the housing thereby forming a plurality of protruding pins, and a biasing member biasing the housing in a direction. Here, at least one of the plurality of protruding pins is insertable to the penetration hole formed in the frame.

Furthermore, an image forming apparatus according to an aspect of the present invention includes: an optical scanning device emitting a light beam and performing a scanning; an image supporting body creating an electrostatic latent image by being irradiated with the light beam; and an imaging device creating a toner image by developing the electrostatic latent image. Here, the optical scanning device is fixed by the fixing mechanism described in the previous paragraph.

EFFECT OF THE INVENTION

According to the present invention, a position of a housing is determined, and the housing is supported by penetrating a protruding pin through a penetration hole, and, in this condition, the housing is biased in one direction by a biasing part. In other words, according to the present invention, the housing is not fixed rigidly to the frame. When a force is applied, which exceeds a biasing force received by the housing from the biasing part, a deformation of the housing or a change in the position of the housing are allowed.

Therefore, according to the present invention, a localized heat deformation does not occur on the housing. Therefore, a deviation in the position of the scanning line does not occur. Further, it is possible to prevent the print quality from deteriorating.

Moreover, according to the present invention, the position of the housing is determined, and the housing is supported by the biasing part biasing the housing in one direction. Therefore, when the housing is placed at an approximate position at the time of assembly, thereafter, the position of the housing may be determined precisely by the biasing force of the biasing part. Further, since the housing is not fixed rigidly to the frame, the housing may be easily detached as well.

Therefore, according to the present invention, the operability of an assembling process of the optical scanning device is improved, so that a user may exchange the optical scanning device on his or her own without relying on a staff member with specialized technical knowledge.

Figure 1:
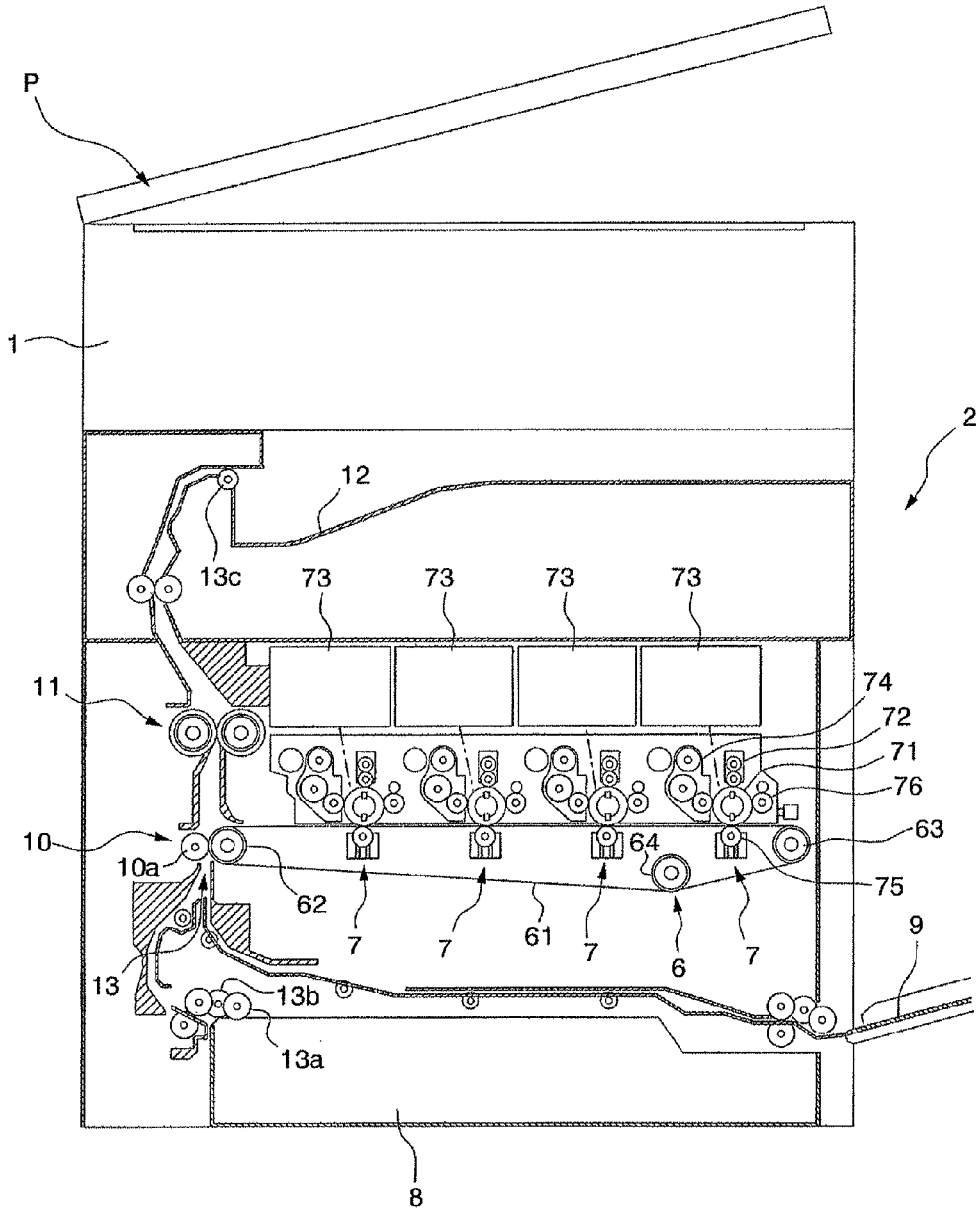
FIG. 1 is a cross sectional diagram showing a skeletal configuration of a copying machine according to a first embodiment of the present invention.

DETAILED DESCRIPTION OF THE PREFERRED EMBODIMENTS (First Embodiment)

Hereinafter, a first embodiment of a fixing mechanism of an optical scanning device and an imaging forming apparatus according to the present invention is described with reference to the diagrams. In the drawings referred to below, the scaling of each component is changed as appropriate so that each component becomes a size which may be recognized. Further, in the description below, a copying machine is provided and described as an example of an image forming apparatus according to the present invention.

FIG. 1 is a cross sectional diagram showing a skeletal configuration of a copying machine P according to the present embodiment. As shown in this diagram, the copying machine P according to the present embodiment comprises an image reading part 1, which reads an image of a draft, and a printing part 2, which makes a printout to a recording paper (recording medium) based on an image data that was read in.

The image reading part 1 irradiates light to an image of a draft, and reads the image of the draft as an image data by receiving a reflected light. Thus, the image reading part 1 comprises a light receiving sensor and the like, which receives a light returning from the draft and a light source device which irradiates light to the draft, and thereby makes a conversion to an image data.

The printing part 2 comprises a belt unit 6, an image forming unit 7, a paper feeding cassette 8, a paper feeding tray 9, a secondary transcription part 10, a fixing part 11, a paper ejection tray 12, and a transportation path 13.

A toner, formed at the image forming unit 7, is transcribed to the belt unit 6. The belt unit 6 transports this transcribed toner. The belt unit 6 comprises an intermediary transcription belt 61, to which a toner is transcribed from the image forming unit 7, a driving roller 62 which bridges the intermediary transcription belt 61 and performs an endless transportation, a driven roller 63, and a tension roller 64.

The intermediary transcription belt 61 is bridged by the driving roller 62, the driven roller 63, and the tension roller 64.

The driving roller 62 is connected to a driving part comprising a driving source such as a motor and the like. The driving roller 62 applies a gripping force with respect to the intermediary transcription belt 61, and makes the intermediary transcription belt 61 run.

The driven roller 63 is driven to rotate along with the rotation of the driving roller 62.

The tension roller 64 is a type of a driven roller which is driven to rate along with the rotation of the driving roller 62. The tension roller 64 comprises a spring mechanism and applies a tension to the intermediary transcription belt 61.

Further, the belt unit 6 also comprises a cleaning part, which is not diagrammed. The cleaning part is configured to remove a toner and the like which has been left in the intermediary transcription belt 61.

The image forming unit 7 is provided corresponding to each of the colors yellow (Y), magenta (M), cyan (C), and black (BK). The image forming unit 7 forms a toner image for each color. In addition, these image forming units 7 are aligned along the intermediary transcription belt 61.

Each image forming unit 7 comprises a photoreceptor 71 being an example of an image supporting body, a charging device 72, a laser scanning unit (optical scanning device) 73, an imaging device 74, a primary transcription roller 75, a cleaning device 76, and a neutralization apparatus which is not diagrammed.

The shape of the photoreceptor 71 is set to be cylindrical. A electrostatic image and a toner image based on the electrostatic image are formed on the surrounding surface of the photoreceptor 71. The charging device 72 is placed opposite to the photoreceptor 71, and charges the surrounding surface of the photoreceptor 71. The laser scanning unit 73 scans a laser beam irradiated based on the image data, in a printing form, over a surrounding surface of the charged photoreceptor 71. The imaging device 74 forms a toner image on the surrounding surface of the photoreceptor 71 based on an electrostatic latent image by supplying a toner with respect to the surrounding surface of the photoreceptor 71. The primary transcription roller 75 is placed opposite to the photoreceptor 71, with the intermediary transcription belt 61 placed in between. The primary transcription roller 75 performs a primary transcription of the toner image, which was formed on the photoreceptor 71, to the intermediary transcription belt 61. The cleaning device 76 removes a toner remaining on top of the photoreceptor 71 after the primary transcription.

The paper feeding cassette 8 may be pulled out freely with respect to the main body of a device. The paper feeding cassette 8 stores a recording paper. The paper feeding tray 9 may be opened and closed with respect to the main body of the device. The paper feeding cassette stores a recording paper.

The secondary transcription part 10 performs a secondary transcription of an image, formed on the intermediary transcription belt 61, onto a recording paper. The secondary transcription part 10 comprises a driving roller 62 which drives the intermediary transcription belt 61, and a secondary transcription roller 10*a* which is placed opposite to the driving roller 62 with the intermediary transcription belt 61 being placed in between.

The fixing part 11 fixes the toner image onto a recording paper, which has undergone a secondary transcription onto the recording paper. The fixing part 11 comprises a heating roller which fixes the toner image onto the recording paper by applying pressure and by providing heat.

The transportation path 13 comprises a pickup roller 13*a*, which transports a recording paper out from the paper feeding cassette 8, a paper feeding roller 13*b*, which transports a recording paper, and a paper ejection roller 13*c* which ejects the recording paper or paper to the paper ejection tray 12.

The copying machine P according to the present embodiment, which is configured as described above, obtains an image data from the image reading part 1. Further, the printing part 2 performs a printout to the recording paper based on the image data.

Figure 2:
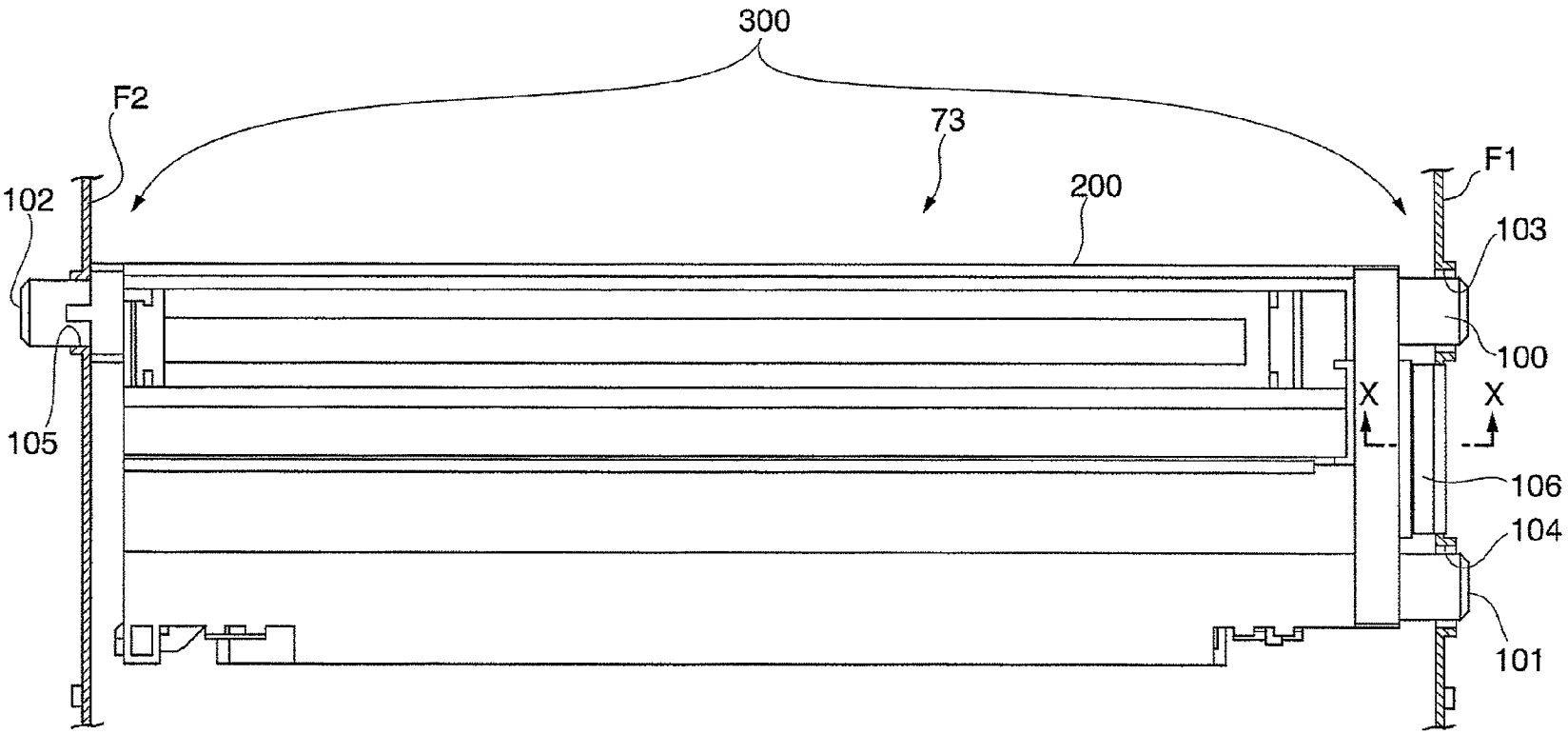
FIG. 2 is an upper surface diagram of a laser scanning unit comprised by a copying machine according to a first embodiment of the present invention.

Next, a laser scanning unit (optical scanning device) 73 of the copying machine P according to the present embodiment is described using FIG. 2. This FIG. 2 is a diagram showing a skeletal configuration of the laser scanning unit, and shows a condition in which the upper cover is removed.

Since each laser scanning unit 73 is configured similarly, only one laser scanning unit 73 is described in the following explanation.

The laser scanning unit 73 comprises a housing 200. This housing 200 comprises plastics material. The interior of the housing 200 is a hollow body comprising a space with a predetermined volume. Furthermore, inside the housing, a light beam generating device, a polygon mirror, a polygon motor, an optical element, and the like are provided. According to the laser scanning unit 73, a light beam emitted from the light beam generating device is led inside the housing, and emitted. Thus, the light beam scans over the photoreceptor 71.

Incidentally, an electrostatic latent image is formed on the photoreceptor 71 due to the light beam emitted by the laser scanning unit 73 being irradiated to the photoreceptor 71.

Hereinafter, a fixing mechanism 300 of the laser scanning unit 73 is described. FIG. 2 shows a condition of the laser scanning unit 73 shown in FIG. 1, such that the laser scanning unit 73 is provided between a pair of frames F1, F2 (not diagrammed in FIG. 1) positioned at the front and back sides of FIG. 1. The pair of frames F1, F2 are provided parallel to each other inside the chassis of the copying machine P, with a predetermined distance constantly being provided between the frames F1, F2.

The assembling of the housing 200 of the laser scanning unit 73 to the frames F1, F2 is performed using three protruding pins 100-102, three penetration holes 103-105, and a spring member 106.

In other words, the fixing mechanism 300 of the laser scanning unit 73 according to the present embodiment comprises the protruding pins 100-102, the penetration holes 103-105, and the spring member 106.

Among the three protruding pins 100-102, two protruding pins 100, 101 are provided on one side surface of the housing 200, with a predetermined distance being provided between the protruding pins 100, 101. The remaining protruding pin 102 is provided on the other side surface of the housing 200 so that the axis of the protruding pin 102 coincides with the axis of one of the two protruding pins 100 or 101. (In the example which is shown in the diagram, the protruding pin 102 is coaxial with the protruding pin 100.)

The length of the three protruding pins 100-102 is set so that all of the protruding pins 100-102 may be inserted inside the penetration holes 103-05. Moreover, the length of the protruding pin 102 is set so that, when the protruding pins 100, 101 are inserted furthest into the penetration holes 103, 104, the protruding pin 102 sticks out from the penetration hole 105. In addition, the radius of the protruding pins 100, 101 is set to be smaller than the radius of the penetration holes 103, 104, so that the protruding pins 100, 101 may be inserted from a slanted direction into the penetration holes 103, 104.

Incidentally, a configuration is possible in which at least one of the penetration holes 103, 104 is shaped as an ellipse which is long in the upper and lower directions, so that the protruding pins 100, 101 may be inserted from a slanted direction.

Here, the protruding pin 102 is provided to be coaxial with the protruding pin 100. However, the protruding pin 102 may be provided to be coaxial with the protruding pin 101. Furthermore, two protruding pins may be provided so as to be coaxial with the two protruding pins 100, 101.

Among the three penetration holes 103-105, two penetration holes 103, 104 are provided on the frame F1 at a position corresponding to the protruding pins 100, 101. The remaining penetration hole 105 is provided on the frame F2 at a position corresponding to the protruding pin 102. The relationship between the penetration holes 103, 104, the protruding pins 100, 101, the penetration hole 105, and the protruding pin 102 is determined so that each protruding pin may be inserted easily into each penetration hole, and so that the inserted penetration pin does not become loose.

Figure 3:
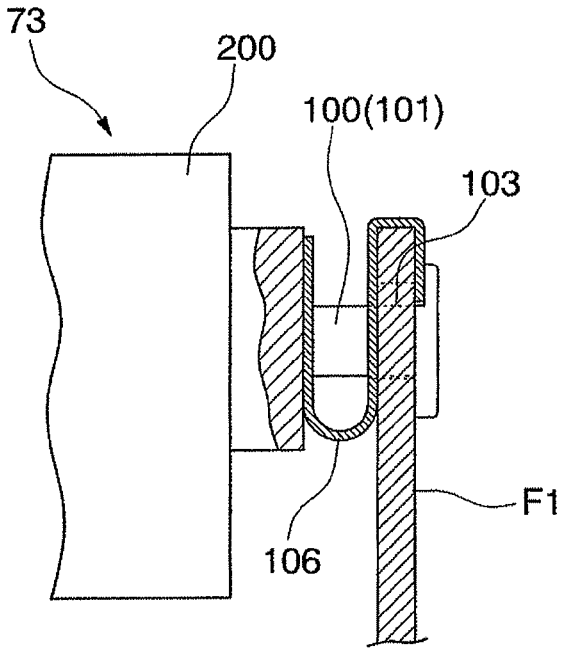
FIG. 3 is an enlarged cross sectional diagram along line X-X of FIG. 2.

The spring member 106 corresponds to the biasing part according to the present invention. As shown in FIG. 3, the spring member 106 comprises a U-shaped board spring, and is provided between one side surface of the housing 200 and the frame F1, and between the protruding pins 100, 101. A housing 200 side of the spring member 106 is fixed to the housing 200. An upper end part of the opposing side is formed in an inverse-U form. A configuration is made so that the inverse-U-shaped part may be inserted to an upper end part of the frame F1.

When the spring member 106 is provided between the housing 200 and the frame F1, as shown in FIG. 2, a compression is made so that the housing is biased towards the direction of the frame F2 (one direction).

Thus, due to the biasing force of the spring member 106, the housing 200 is pressed in the direction of the frame F2. As a result, the positioning of the laser scanning unit 73 is made.

When the laser scanning unit 73 is installed, the protruding pins 100, 101 are first inserted into the insertion holes 103, 104 from an obliquely upward direction. The insertion holes 103, 104 are formed in the frame F1. At this time, by pushing the housing 200 hard, the spring member 106 is greatly compressed. As a result, the protruding pins 100, 101 may be inserted into the penetration holes 103, 104 to the furthest extent. Next, the laser scanning unit 73 is laid down so that the protruding pin 102 faces the penetration hole 105 of the frame F2. Thereafter, the force pushing the housing 200 is released. Thus, due to the restoring force of the spring member 106, the protruding pin 102 is inserted into the penetration hole 105. As a result, the laser scanning unit 73 is positioned and supported as shown in FIG. 2.

In this way, according to the laser scanning unit 73 based on the present embodiment, the protruding pins 100, 101 are first inserted to the penetration holes 103, 103 to the furthest extent from an obliquely upward direction. Thereafter, the housing 200 is laid down and is moved towards a direction in which the protruding pins 100, 101 move out from the penetration holes 103, 104. Due to this switch back movement, the housing is fixed with respect to the frames F1, F2.

Meanwhile, when the laser scanning unit 73 is taken out, the spring member 106 is further compressed, so that the protruding pin 102 is pulled out from the penetration hole 105. Thereafter, the housing 200 is tilted towards the front side, and the laser scanning unit 73 is removed by pulling out the protruding pins 100, 101 from the penetration holes 103, 104.

According to the fixing mechanism 300 of the laser scanning unit 73 based on the present embodiment as described above, the protruding pins 100-102 are inserted into the penetration holes 103-105, and in this condition, the housing 200 is biased in one direction with the spring member 106. In this way, the positioning and the support of the housing 200 are made. In other words, according to the fixing mechanism 300 of the laser scanning unit 73 based on the present embodiment, the housing 200 is not rigidly fixed with respect to the frames F1, F2. When a force, which is greater than the biasing force received by the housing 200 from the spring member 106, is applied, the housing 200 is allowed to deform or change its position.

Therefore, according to the fixing mechanism 300 of the laser scanning unit 73 based on the present embodiment, localized heat deformation does not occur on the housing 200. Therefore, the location of the scanning line does not deviate. Thus, it is possible to prevent a deterioration in the quality of printing.

In addition, according to the fixing mechanism 300 of the laser scanning unit 73 based on the present embodiment, the housing 200 is positioned and supported due to the housing 200 being biased in one direction by the spring member 106. As a result, as long as the housing 200 is placed in an approximately correct position at the time of assembling, thereafter, the housing 200 may be positioned at a correct position due to the biasing force of the spring member 106. Further, since the housing 200 is not fixed rigidly to the frames F1, F2, the housing 200 may be easily detached as well.

Therefore, according to the present invention, the operability of an assembling process of the optical scanning device is improved, so that a user may exchange the optical scanning device on his or her own without relying on a staff member with specialized technical knowledge.

(Second Embodiment)

Hereinafter, a second embodiment of the present invention is described with reference to FIG. 4. In this description of the second embodiment, the same reference numerals are used for the same components described in the first embodiment. These overlapping components are not described in the second embodiment to prevent redundancy.

A fixing mechanism 400 of a laser scanning unit 73 according to the second embodiment comprises protruding pins 100*a*, 101*a*, and 102*a*, which correspond to the protruding pins 100, 101, and 102 in the first embodiment; penetration holes 103*a*, 104*a*, and 105*a*, which correspond to the penetration holes 103, 104, and 105; and a biasing mechanism 500 (biasing part).

Insertion holes 100*b*, 101*b* are provided respectively to the protruding pins 100*a*, 101*a* in a central axial direction. Further, in the present embodiment, the length of the protruding pins 100*a*, 101*a* is set so that, in a condition in which the protruding pin 102*a* is inserted in the penetration hole 105*a* to the furthest extent, the tip end does not reach the penetration holes 103*a*, 104*a*.

In addition, the radius of the protruding pin 102*a* is set to be smaller than the radius of the penetration hole 105*a*, so that the protruding pin 102*a* may be inserted from an obliquely upward direction into the penetration hole 105*a*. Incidentally, a configuration is possible in which the penetration hole 105*a* is shaped as an ellipse which is long in the upper and lower directions, so that the protruding pin 102*a* may be inserted from a slanted direction.

The biasing mechanism 500 biases the housing 200 in a direction towards the frame F2 (one direction). The biasing mechanism 500 comprises a spring member 106*a*, a plate member 107, and a positioning pin 108, 109.

The spring member 106*a* is a tension spring. One end of the spring member 106*a* is fixed to the frame F1, while the other end is fixed to one surface of the plate member 107.

The length of the plate member 107 in the longitudinal direction is determined so as to be slightly longer than the distance between the protruding pins 100*a*, 101*a*. Further, the plate member 107 is constantly biased by the 106*a* so that the plate member 107 is pulled towards the frame F1.

The positioning pins 108, 109 are both provided on the plate member 107. The positioning pins 108, 109 are placed so as to protrude in the direction of the protruding pins 100*a*, 101*a* at a position so as to face the protruding pins 100*a*, 101*a* respectively.

A protruding part 108*a*, 109*a* is provided at a tip of the positioning pins 108, 109 respectively, so that the protruding parts 108*a*, 109*a* may be inserted into the insertion holes 100*b*, 101*b* provided in the protruding pins 100*a*, 101*a*.

Figure 4:
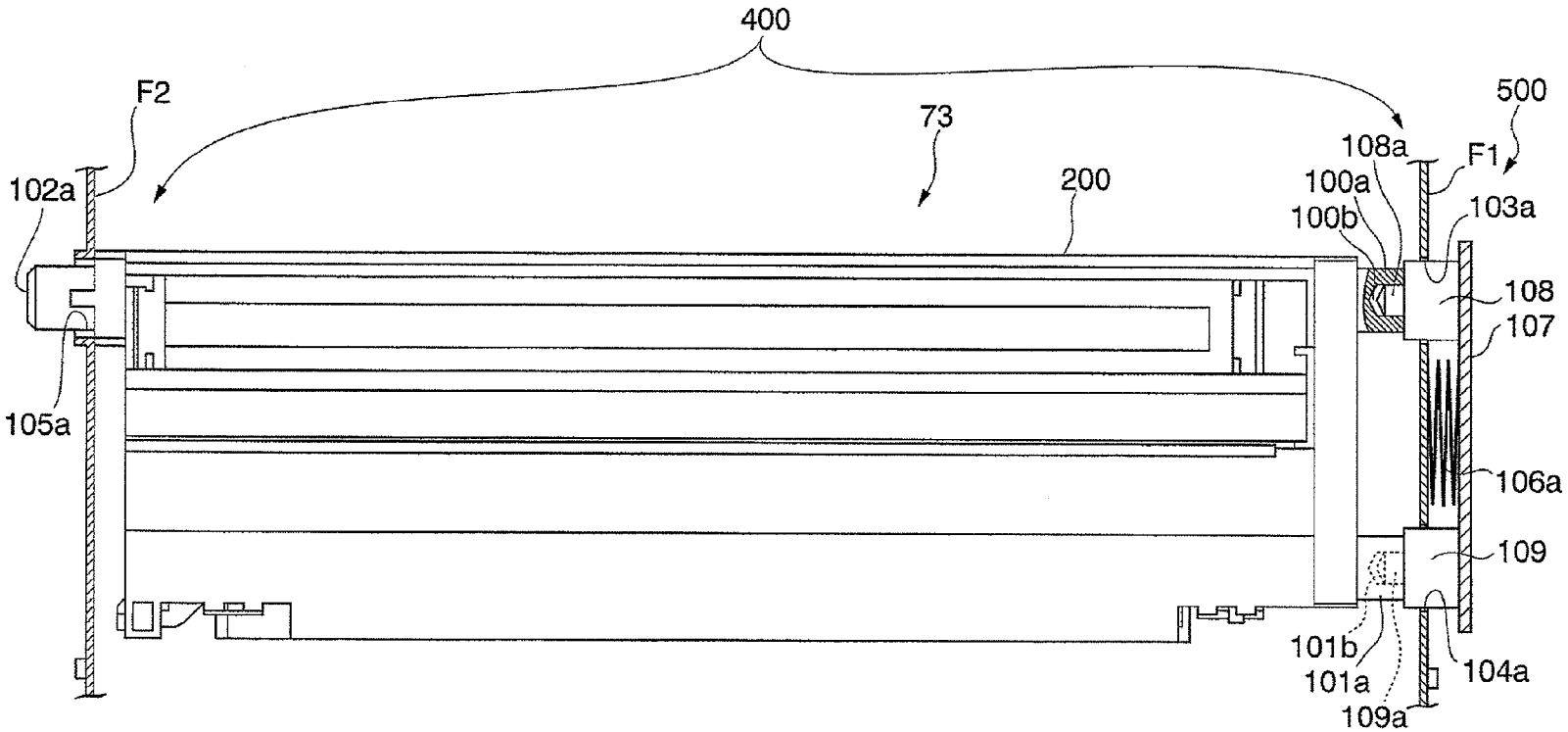
FIG. 4 is an upper surface diagram of a laser scanning unit comprised by a copying machine according to a second embodiment of the present invention.

Further, these positioning pins 108, 109 are configured so that the positioning pins 108, 109 may be inserted into the penetration holes 103*a*, 104*a* provided at the same place as the penetration holes 103, 104 in the first embodiment (see FIG. 4).

When the laser scanning unit 73 is installed, the protruding pin 102*a* is first inserted into the insertion hole 105*a* from an obliquely upward direction. The insertion hole 105*a* is formed in the frame F2. Next, while the plate member 107 is pulled, the laser scanning unit 73 is laid down so that the insertion holes 100*b*, 101*b* provided in the protruding pins 100*a*, 101*a* face the protruding members 108*a*, 109*a* of the positioning pins 108, 109. Next, the plate member 107 is returned, and the protruding members 108*a*, 109*a* are inserted into the insertion holes 100*b*, 101*b*. At the same time, the positioning pins 108, 109 are inserted into the penetration holes 103*a*, 104*a*.

Therefore, as shown in FIG. 4, the laser scanning unit 73 is positioned and supported.

Meanwhile, when the laser scanning unit 73 is taken out, the protruding members 108*a*, 109*a* are pulled out from the insertion holes 100*b*, 101*b* by pulling plate member 107. After the laser scanning unit 73 is tilted towards the front side, the protruding pin 102*a* is pulled out from the penetration hole 105*a*. In this way, the laser scanning unit 73 is removed.

According to the fixing mechanism 400 of the laser scanning unit 73 based on the present embodiment as described above, the protruding pin 102*a* is inserted in the penetration hole 105*a*. In this condition, the housing 200 is biased in one direction by the biasing mechanism 500. Thus, the housing 200 is positioned and supported. IN other words, according to the fixing mechanism 400 of the laser scanning unit 73 based on the present embodiment as described above, the housing 200 is not rigidly fixed with respect to the frames F1, F2. When a force, which is greater than the biasing force received by the housing 200 from the biasing mechanism 500, is applied, the housing 200 is allowed to deform or change its position.

Therefore, according to the fixing mechanism 400 of the laser scanning unit 73 based on the present embodiment, localized heat deformation does not occur on the housing 200. Therefore, the location of the scanning line does not deviate. Thus, it is possible to prevent a deterioration in the quality of printing.

In addition, according to the fixing mechanism 400 of the laser scanning unit 73 based on the present embodiment, the housing 200 is positioned and supported due to the housing 200 being biased in one direction by the biasing mechanism 500. As a result, as long as the housing 200 is placed in an approximately correct position at the time of assembling, thereafter, the housing 200 may be positioned at a correct position due to the biasing force of the biasing mechanism 500. Further, since the housing 200 is not fixed rigidly to the frames F1, F2, the housing 200 may be easily detached as well.

Therefore, according to the fixing mechanism 400 of the laser scanning unit 73 based on the present embodiment, the operability of an assembling process of the optical scanning device is improved, so that a user may exchange the optical scanning device on his or her own without relying on a staff member with specialized technical knowledge.

(Third Embodiment)

Next, a third embodiment of the present invention is described with reference to FIGS. 5 and 6. Incidentally, in this description of the third embodiment, the same reference numerals are used for the same components described in the first embodiment. These overlapping components are not described in the second embodiment to prevent redundancy.

According to a fixing mechanism 600 of a laser scanning unit 73 based on the third embodiment, the frame F2 side is configured similarly to the first embodiment, and therefore is not described here.

Figure 5:
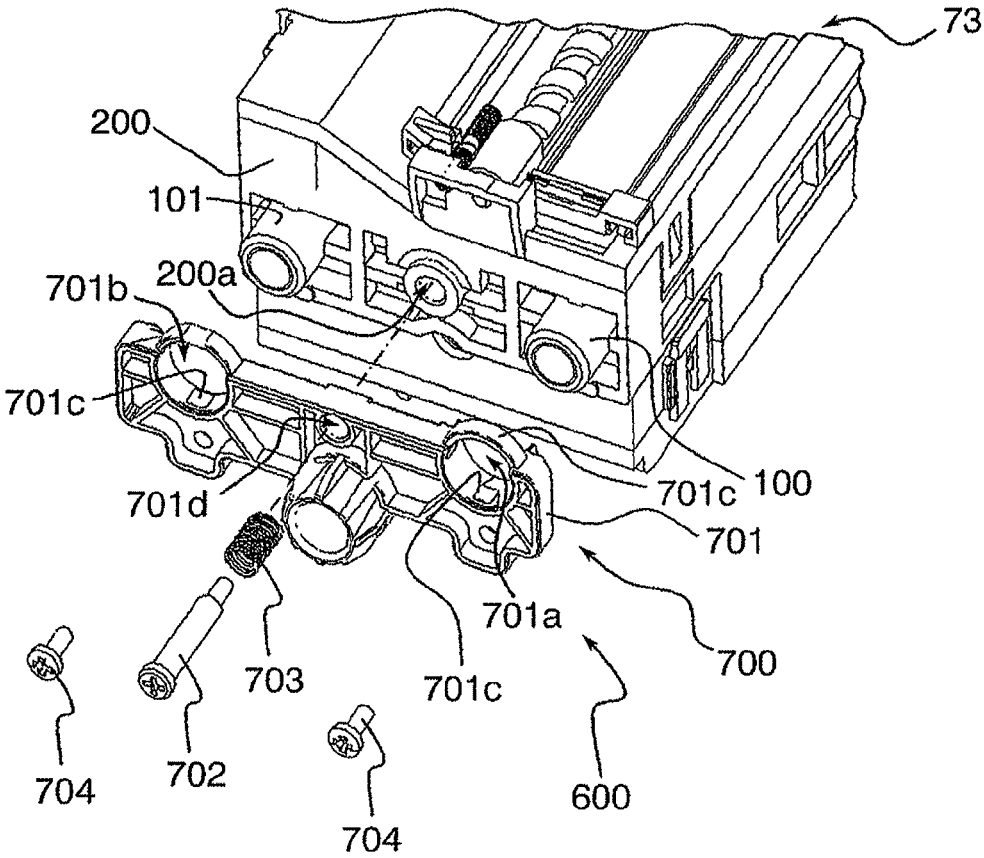
FIG. 5 is a perspective view including a side surface of a laser scanning unit comprised by a copying machine according to a third embodiment of the present invention.

Moreover, the fixing mechanism 600 of the laser scanning unit 73 based on the present embodiment comprises a biasing mechanism 700 (biasing part) in addition to the configuration at the frame F2 side (the protruding pin 102 and the penetration hole 105), as shown in FIG. 5. Incidentally, the frame F1 is not shown in FIG. 5.

The biasing mechanism 700 biases and pulls in the housing 200 of the laser scanning unit 73 towards the frame F1 side. The biasing mechanism 700 comprises a plate member 701, a header pin 702, a spring member 703, and a screw 704.

Figure 6:
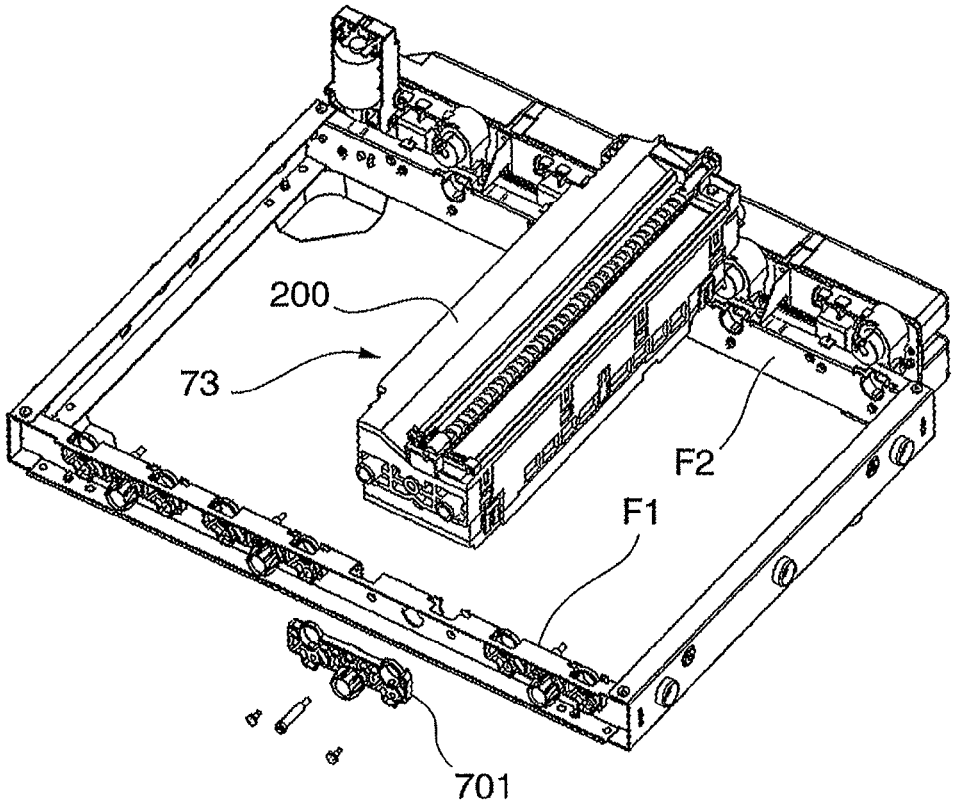
FIG. 6 is a perspective view including a laser scanning unit and a frame comprised by a copying machine according to a third embodiment of the present invention.

The plate member 701 is fixed to an outer side of the frame F1 (an opposite side compared to a side at which the laser scanning unit 73 is placed), as shown in FIG. 6, so that the plate member 701 is exposed from an opening provided on the frame F1.

As shown in FIG. 5, the plate member 701 comprises a fitting hole 701*a*, into which the protruding pin 100 of the laser scanning unit 73 is fitted, and a fitting hole 701*b*, into which the protruding pin 101 is fitted. A plurality of protruding parts 701*c* are provided (in the present embodiment, three protruding parts are provided) at an inner wall surface of the fitting holes 701*a*, 701*b*. The positions of the protruding pins 100, 101 are determined as the peripheral surface of the protruding pins 100, 101 contacts the protruding parts 701*c*.

Furthermore, an insertion hole 701*d* is provided at approximately a center portion of the plate member 701. The insertion hole 701*d* is used to pull the header pin 702 from the outer side of the frame F towards the inner side. Incidentally, the radius of the insertion hole 701*d* is set to be smaller than the head of the header pin 702.

Further, according to the present embodiment, an insertion hole 200*a* is also provided with respect to the housing 200 of the laser scanning unit 73 in order to insert the tip (an opposite side compared to the head) of the header pin 702. Further, the tip of the header pin 702 is placed as shown in FIG. 5, passing through the insertion hole 701*d* and the insertion hole 200*a* from the outer side. The tip of the header pin 702 is placed in an interior part of the housing 200. The tip of the header pin 702 is screwed together with a nut (not diagrammed) which has a larger radius compared to the insertion hole 200*a*. This header pin 702 is fixed to the housing 200 due to the nut being latched to the housing 200.

The spring member 703 is provided between the head of the header pin 702 and the plate member 701. The spring member 703 biases the header pin 702 towards the outer side (a side moving away from the plate member 701).

In this way, since the header pin 702 is biased towards the outer side, the housing fixed with the header 702 is biased and pulled towards the frame F1 side.

The screw 704 is a component positioning and fixing the plate member 701 with respect to the frame F1. In the present embodiment, two screws are provided. According to the fixing mechanism 600 of the laser scanning unit 73 as described above, the housing 200 is positioned and supported due to the biasing mechanism 700 biasing the housing 200 in one direction. In other words, according to the fixing mechanism 600 of the laser scanning unit 73 based on the present embodiment, the housing 200 is not rigidly fixed with respect to the frames F1, F2. When a force, which is greater than the biasing force received by the housing 200 from the spring member 703, is applied, the housing 200 is allowed to deform or change its position.

Therefore, according to the fixing mechanism 600 of the laser scanning unit 73 based on the present embodiment, localized heat deformation does not occur on the housing 200. Therefore, the location of the scanning line does not deviate. Thus, it is possible to prevent a deterioration in the quality of printing.

In addition, according to the fixing mechanism 600 of the laser scanning unit 73 based on the present embodiment, the housing 200 is positioned and supported due to the housing 200 being biased in one direction by the spring member 703. As a result, as long as the housing 200 is placed in an approximately correct position at the time of assembling, thereafter, the housing 200 may be positioned at a correct position due to the biasing force of the spring member 703. Further, since the housing 200 is not fixed rigidly to the frames F1, F2, the housing 200 may be easily detached as well.

Therefore, according to the fixing mechanism 600 of the laser scanning unit 73 based on the present embodiment, the operability of an assembling process of the optical scanning device is improved, so that a user may exchange the optical scanning device on his or her own without relying on a staff member with specialized technical knowledge.

While a preferred embodiment of the present invention has been described above with reference to the attached figures, it should be understood that these are exemplary of the invention and are not to be considered as limiting the present invention. Additions, omissions, substitutions, and other modifications can be made without departing from the scope of the present invention.

For instance, in the embodiment described above, a configuration was described in which the laser scanning unit 73, which is an example of the optical scanning device according to the present invention, is mounted on a copying machine being one of the image forming devices.

However, the optical scanning device according to the present invention is not limited to this configuration. Instead of an image forming device such as a copying machine, the optical scanning device may be mounted on devices such as a measuring equipment, an inspection equipment, and the like.

What is claimed is:

1. A fixing mechanism of an optical scanning device, the optical scanning device emitting a light beam and performing a scanning, the optical scanning device comprising a housing that is fixed to a pair of frames at an external part, the pair of frames facing each other and the fixing mechanism comprising:

a penetration hole provided in each of the pair of frames; and a plurality of protruding pins each provided at a respective end of the housing of the optical scanning device and each pin extending in a direction transverse to the pair of frames, wherein at least a first one of the plurality of protruding pins is insertable into the penetration hole formed in a first one of the frames; and a biasing mechanism biasing the housing of the optical scanning device in a direction transverse to the pair of frames, wherein:

the biasing mechanism comprises:

a plate member fixed to the first one of the frames;

a header pin passing through the plate member and fixed to the housing; and a biasing member provided between a head of the header pin and the plate member that biases the header pin away from the plate member; wherein the plate member comprises a fitting hole through which the at least first one of the plurality of protruding pins is fittable; and a notch formed in the first one of the frames at the location of the fitting hole in the plate member.

2. An image forming apparatus comprising:

an optical scanning device emitting a light beam and performing a scanning;

an image supporting body creating an electrostatic latent image by being irradiated with the light beam; and an imaging device creating a toner image by developing the electrostatic latent image, wherein the optical scanning device is fixed by the fixing mechanism according to claim 1.

* * * * *